United States Patent [19]

Perilli

[11] Patent Number: 4,627,623

[45] Date of Patent: Dec. 9, 1986

[54] HANDHELD DEVICE FOR BALL GAME

[76] Inventor: Francesco Perilli, Piazza T. Marconi 21, 64015 Nereto Teramo, Italy

[21] Appl. No.: 772,550

[22] Filed: Sep. 4, 1985

[30] Foreign Application Priority Data

Feb. 22, 1985 [CA] Canada ..... 474978

[51] Int. Cl.[4] ..... A63B 59/00; A63B 67/00

[52] U.S. Cl. ..... 273/328; 273/67 R

[58] Field of Search ..... 273/328, 67 R

[56] References Cited

U.S. PATENT DOCUMENTS

| | | | |
|---|---|---|---|
| 1,184,822 | 5/1916 | Caplette, Jr. | 273/328 |
| 1,189,921 | 7/1916 | Cory | 273/328 |
| 1,671,749 | 5/1928 | Spaulding | 273/328 |
| 1,930,281 | 10/1933 | Ogden | 273/67 R |
| 1,964,232 | 6/1934 | Tromblee | 273/328 |
| 2,194,761 | 3/1940 | Maihack | 273/328 X |
| 2,242,122 | 5/1941 | Glover et al. | 273/328 |
| 2,480,264 | 8/1949 | Regenold | 273/328 |
| 3,185,476 | 5/1965 | Fechner | 273/67 R X |
| 4,084,820 | 4/1978 | Olson, Jr. | 273/328 X |

FOREIGN PATENT DOCUMENTS

| | | | |
|---|---|---|---|
| 207907 | 3/1909 | Fed. Rep. of Germany | 273/328 |
| 2525480 | 10/1983 | France | 273/67 R |

*Primary Examiner*—William H. Grieb

*Attorney, Agent, or Firm*—Moss, Hammond

[57] ABSTRACT

A device for catching and hitting a ball, such as a tennis ball, including a pocket adapted to catch a ball, closed at one end and open at the other end, and a hand enclosure in which is a handle for holding the device. A loop-forming frame extends from and is connected to one side of the enclosure and the open end of the pocket is connected to this frame. The preferred device has three exterior surfaces provided thereon and adapted for hitting a ball. A ball game can be played with the device either by a lone player or by a number of players.

18 Claims, 4 Drawing Figures

HANDHELD DEVICE FOR BALL GAME

BACKGROUND OF THE INVENTION

This invention relates to game devices and particularly a device for playing with and catching a ball.

A variety of catching devices for various games are well known at the present time. For example mitts for catching baseballs are known and these are made from leather or a leather substitute. These mitts are flexible so that they can be opened or closed by the player's hand. A mitt or glove is also used in ice hockey to permit the goalie to catch a puck. Mitts or gloves of this nature however are not designed for striking or hitting the ball or puck in order to drive the ball or puck to a desired location or to another player.

Racquets and other ball-hitting devices are also well known but generally speaking such devices cannot be used to catch or hold a ball. The well known tennis racquet has a circular frame between which is stretched suitable netting. A rather large handle extends from one end of the circular frame and by this handle the racquet can be grasped and swung. Similar racquets are also used in the game of squash and in badminton. Wooden or metal bats are used in baseball or in cricket for striking the ball.

U.S. Pat. No. 2,242,122 issued May 13, 1941 to W. A. Glover et al discloses a game apparatus that includes a handle, a supporting ring secured to the handle, a net carried by the ring for catching a ball, and a flat spring having one end thereof secured to the handle. The spring has a free end with a ball holding device mounted thereon. The ball can be flung by means of the spring and another player having a similar device can attempt to catch the ball in his net.

U.S. Pat. No. 2,480,264 issued Aug. 30, 1949 to F. A. Regenold describes a bat that can be used to either strike or catch a ball. The bat is held by an exposed handle, one end of which is fastened to a flat disc having a hole in the centre thereof. The disc portion can be used to strike or hit a ball. At the back of the centre hole is a pocket made from netting so that a ball can be caught if it passes through the centre hole during the game. In such a game, the ball is batted back and forth between opposing players until one of the players catches the ball in the pocket.

It is an object of the present invention to provide a novel game device that permits a player to either catch a ball or to strike it using two or more exterior surfaces of the device.

It is a further object of the invention to provide a game device that permits a challenging game to be played by one or more players. It also helps to develop hand and eye co-ordination.

SUMMARY OF THE INVENTION

According to the present invention a game device for catching and hitting a ball includes pocket means adapted to catch a ball, closed at one end and open at the other end and a hand enclosure. A frame extends from and is connected to one side of the enclosure to which the open end of the pocket means is connected. Handle means are attached to and are located in the hand enclosure so that the device can be held in one hand. The hand enclosure has two or more exterior surfaces provided thereon and adapted for hitting the ball.

In a preferred embodiment of the device, the exterior surfaces adapted for hitting the ball include a side surface extending in a plane that is parallel to the longitudinal axis of the handle means. The exterior surfaces also include a top surface of the enclosure disposed at one side of the frame and the open end of the pocket means.

According to another aspect of the invention, a game device for catching and hitting a ball comprises a hand enclosure having bottom, top and front sides and a vertical side extending between the bottom and top sides and rearwardly from the front side. A loop-forming frame extends from and is connected to one side of the enclosure. In addition there is a pocket adapted to catch a ball, which pocket is closed at one end and open at the other end. The pocket is attached to the frame at the open end thereof. A handle is arranged in the enclosure and is connected thereto. The hand enclosure has two or more exterior surfaces provided thereon and adapted for hitting the ball.

Further features and advantages will become apparent from the following detailed description when taken into conjunction with the accompanying drawings.

DETAILED DESCRIPTION OF PREFERRED EMBODIMENT

Figure 1:
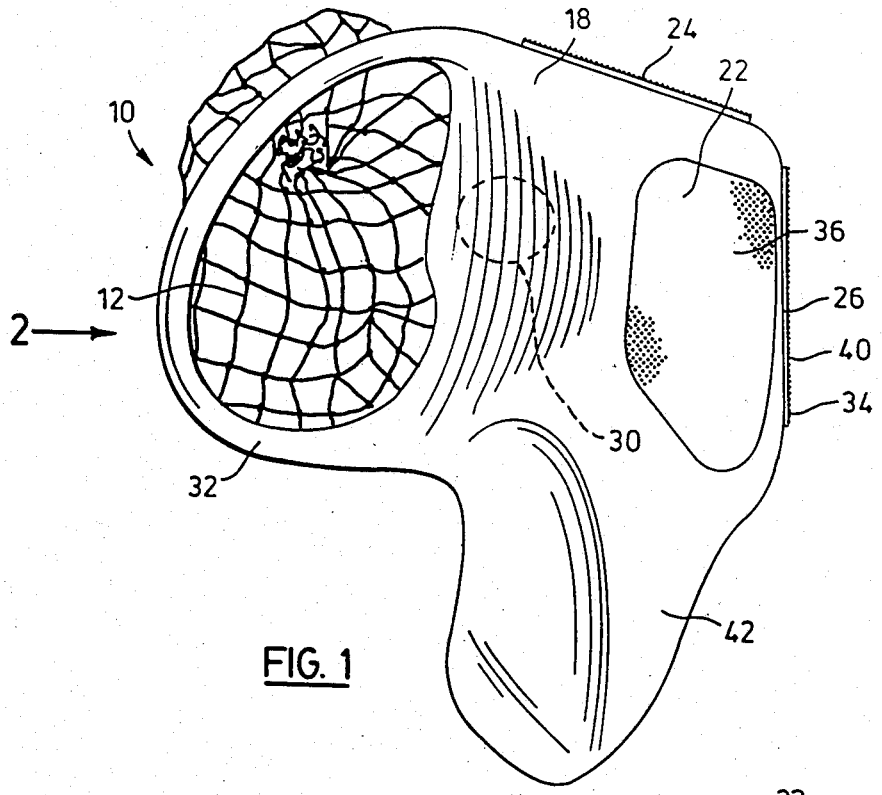
FIG. 1 is a top view of a game device constructed in accordance with the present invention viewed from the direction of arrow 1 shown in FIG. 2.
Figure 2:
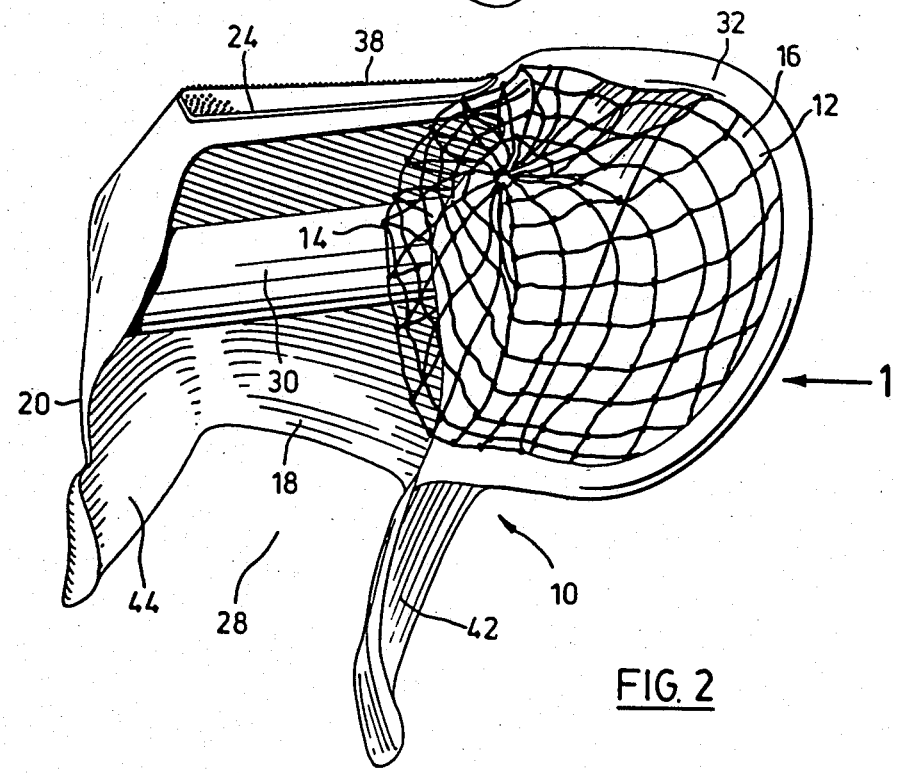
FIG. 2 is a side view showing the open side of the device in the direction of the arrow 2 shown in FIG. 1.
Figure 3:
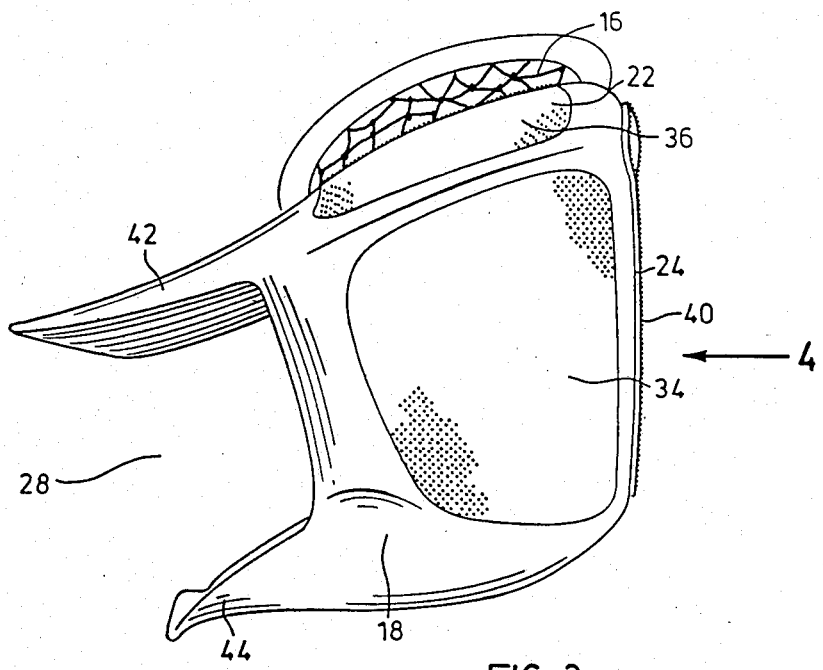
FIG. 3 is a side elevation showing the right side in the direction of the arrow shown in FIG. 4.
Figure 4:
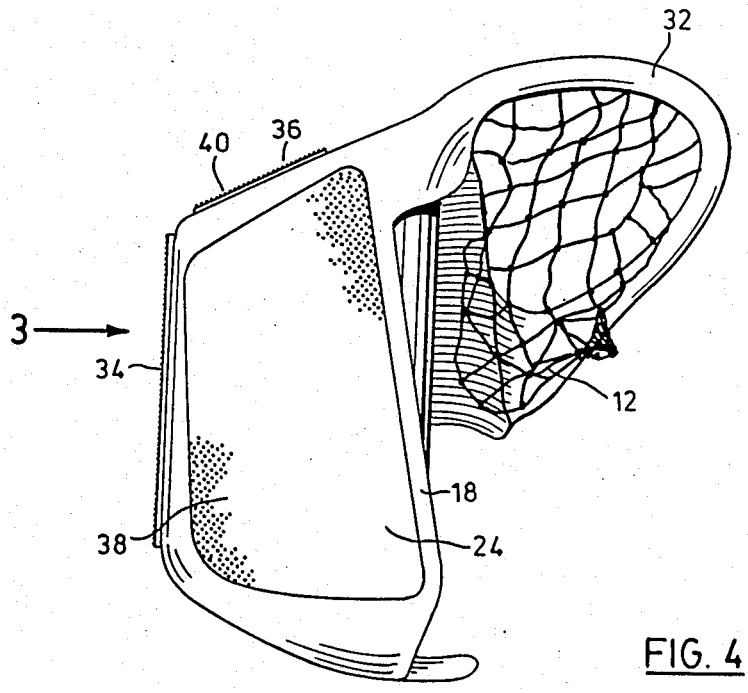
FIG. 4 is a front view of the game device in the direction of the arrow 4 shown in FIG. 3.

The game device 10 of the present invention can be used to either catch or hit a ball such as a tennis ball or a ball that is somewhat smaller than and harder than a tennis ball. The device 10 has pocket means 12 which in the illustrated embodiment is made from string netting. As shown the pocket is closed at one end 14 and open at the other end 16, which in the drawings is the top end. The body of the device forms a hand enclosure 18 which in the preferred embodiment is made of a rigid material such as hard plastic or fibreglass. The preferred hand enclosure has a bottom 20, a top 22 and a front side 24, all of which are integrally connected together. There is also a vertical side 26 extending between the bottom and top sides and extending rearwardly from the front side 24. As shown in FIG. 1, the vertical side 26 can be arranged in a plane that extends at an obtuse angle to the front side 24. As shown in FIG. 2 the side of the enclosure facing towards the pocket 12 is substantially open as is the rear side at 28.

Extending between the top and bottom sides is handle means 30 which can comprise a bar of circular cross-section rigidly attached to the hand enclosure. Preferably the handle has a textured surface so that it can be gripped easily and firmly. It can for example be covered with perforated leather in the same manner as the handle of a tennis racquet so as to provide a comfortable but firm grip.

To provide the necessary support for the open end of the pocket 12, there is a loop-forming frame 32. The opening in this frame must be large enough to permit the ball that is to be used with the device to pass through the opening. In the illustrated device which can be used with a standard tennis ball, the opening in the frame is large enough to permit easy passage of such a ball therethrough. For example an opening approximately four inches in diameter will suffice for catching a tennis ball. As the opening in the frame need not be perfectly circular, the diameter of the opening depending on the direction of measurement can vary. In one preferred embodiment the frame 32 is made from a metal loop or strap that is covered in hard plastic or fibreglass. This hard plastic or fibreglass can be an integral extension of the material used to make the hand enclosure.

The hand enclosure has two or more exterior surfaces provided thereon and adapted for hitting or striking the ball. In the illustrated embodiment there are three of such surfaces and these include a side surface 34 that extends in a plane that is generally parallel to the longitudinal axis of the handle 30, and a top surface 36. The latter surface is disposed at one side of the frame 32 adjacent the open end of the pocket 12. A third exterior surface 38 adapted for hitting the ball extends over the front side 24. These three surfaces are substantially flat so that the ball can be directed as desired by the player and they are preferably formed by a very resilient rubber or rubber like layer of material. This material can be glued or otherwise bonded to the rigid plastic or fibreglass material that forms the hand enclosure 18. In one particular preferred embodiment the layer of material is similar to or the same as that material that is often used to cover ping-pong bats. This material has a textured exterior surface that can be formed by rows of closely adjacent and small bumps or projections 40. As this material is well known for use on bats, further detailed description is deemed unnecessary.

As illustrated in the drawings, the frame 32 holding the open end of the pocket can be arranged in a plane that extends at an acute angle to the longitudinal axis of the handle means. This angle can be in the 50 degrees to 60 degrees range. The angle of the frame permits a ball to be caught in the pocket as the device is being swung sideways, that is in a direction perpendicular to the longitudinal axis of the handle. In addition a ball can be caught when the device is being held still with the handle upright or when the device is being swung upwardly. It will also be appreciated that the three ball-striking surfaces on the device permit a variety of motions to be used to strike or hit a ball. For example the ball could be bunted with the front surface or it could be hit upwardly with the top surface 36. The ball can also be struck a considerable distance in the horizontal direction by the use of an arm swinging motion and by striking the ball with the side surface 34. The number of possible plays permitted with this device permits an exciting and fast-moving game that can include a number of possible ball playing motions.

A further preferred feature of the illustrated device are two rearward extensions 42 and 44. These extension which can be formed of the same hard material as the hand enclosure provide protection for the wrist and forearm of the user and, depending upon their particular construction, they may also assist the user in supporting and maneuvering the device during the play of a game. The edges of these extensions should be rounded or smoothed so that they will not cut into the player's arm or wrist The present game device 10 can be used for play by individuals or by a group of players. In the case of a single player, the device can be used to hit a ball against a hard vertical surface such as a wall and then the player can attempt to either catch the ball in the net or to strike the ball again towards the wall. Alternatively if no wall is available, a ball can simply be tossed into the air and a player can attempt to catch the ball in the net of the device. If he is unable to catch the ball, he may still be able to strike the ball with the device to give him another opportunity to catch the ball. The object of either game would be for the player to ultimately catch the ball in the net.

If a group is to play a game and each player is provided with the game device 10, a player on one team can attempt to hit the ball to another person on his team, which other person will attempt to catch the ball in his net. At the same time a person on the other team may also attempt to catch the ball that has been hit and, failing this, he may be able to strike the ball to a player on his team who can then catch the ball. The score for each team will depend upon the number of times that the ball has been successfully caught in the nets of the players on a particular team. Obviously there are many variations and possibilities for the rules that could be used for a game played with the present device. For example there can be a rule as to the number of times that a player or players can strike or throw the ball with the device before it must be caught in a player's net. It will be further appreciated that the present device can be used either for pure recreation or as a fun sport or it can be used for an agonistic or combative sport, particularly when several players are involved.

It will be obvious to those skilled in the construction of game devices that various modifications and changes can be made to the illustrated and described game device without departing from the spirit and scope of this invention. Accordingly all such modifications and changes as fall within the scope of the appended claims are intended to be covered by this invention.

What I claim as my invention is:

1. A game device for catching and hitting a ball comprising pocket means adapted to catch a ball, closed at one end and open at the other end, a hand enclosure, a frame extending from and connected to one side of said enclosure to which the open end of said pocket means is connected, handle means attached to and located in said hand enclosure whereby said device can be held in one hand, and wherein said hand enclosure has two or more exterior surfaces provided thereon and adapated for hitting said ball.

2. A game device according to claim 1 wherein said exterior surfaces adapted for hitting said ball include a side surface extending in a plane that is parallel to the longitudinal axis of said handle means.

3. A game device according to claim 2 wherein said exterior surfaces adapted for hitting said ball include a top surface of said enclosure disposed at one side of said frame and the open end of said pocket means.

4. A game device according to claim 3 wherein said exterior surfaces adapted for hitting said ball include a third exterior surface of said enclosure extending over the front thereof.

5. A game device according to claim 3 wherein said exterior surfaces adapted for hitting said ball comprise very resilient rubber or rubberlike layers mounted on a rigid material that forms said hand enclosure.

6. A game device according to claim 3 wherein said frame forms an opening approximately four inches in diameter.

7. A game device according to claim 3 wherein said frame forms an opening large enough to permit easy passage of a standard tennis ball therethrough.

8. A game device according to claim 1 wherein said pocket means is made from netting.

9. A game device according to claim 3 wherein said frame is disposed generally in a plane extending at an acute angle to the longitudinal axis of the handle means.

10. A game device according to claim 1 wherein said hand enclosure is open at the rear thereof and has two rearward extensions at the top and bottom thereof, said extensions providing protection for a user's wrist and forearm.

11. A game device for catching and hitting a ball comprising a hand enclosure having bottom, top, and front sides and a vertical side extending between the bottom and top sides and rearwardly from said front sides, a loop-forming frame extending from and connected to one side of said enclosure, pocket means adapted to catch a ball, closed at one end and open at the other end, said pocket means being attached to said frame at the open end thereof, and a handle arranged in said hand enclosure and connected thereto, wherein said hand enclosure has two or more exterior surfaces provided thereon and adapted for hitting said ball.

12. A game device according to claim 11 wherein said exterior surfaces adapted for hitting said ball include the exterior of said vertical side that extends rearwardly from said front side.

13. A game device according to claim 12 wherein said exterior surfaces adapted for hitting said ball include at least part of the exterior of said top side.

14. A game device according to claim 13 wherein there are three exterior surfaces adapted for hitting said ball.

15. A game device according to claim 13 wherein said exterior surfaces adapted for hitting said ball comprise layers of rubber or rubberlike material that is covered with rows of closely adjacent, highly resilient bumps or projections.

16. A game device according to claim 13 wherein said frame forms an opening at least large enough to permit passage of a standard tennis ball therethrough.

17. A game device according to claim 11 wherein said pocket means is made of flexible netting.

18. A game device according to claim 11 wherein said frame extends outwardly from one edge of the top side of said enclosure.

* * * * *